US007164336B2

(12) United States Patent
Rausch et al.

(10) Patent No.: US 7,164,336 B2
(45) **Date of Patent: *Jan. 16, 2007**

(54) ACTUATOR FOR A FLUID VALVE

(75) Inventors: Hartmuth Rausch, Korschenbroich (DE); Peter-Klaus Budig, Chemnitz (DE); Ralf Werner, Chemnitz (DE)

(73) Assignee: Parker Hannifin GmbH & Co. KG, Kaarst (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/443,237

(22) Filed: May 23, 2003

(65) Prior Publication Data

US 2004/0003849 A1 Jan. 8, 2004

Related U.S. Application Data

(63) Continuation-in-part of application No. 10/416,707, filed as application No. PCT/EP01/13200 on Nov. 14, 2001, now Pat. No. 6,975,195.

(30) Foreign Application Priority Data

Nov. 14, 2000 (DE) ..... 100 56 332

(51) Int. Cl.
*H01F 7/08* (2006.01)

(52) U.S. Cl. ..... 335/220; 335/229

(58) Field of Classification Search ..... 335/220–231, 335/234–235; 310/12, 156.38–156.47; 251/129.1–129.19
See application file for complete search history.

(56) References Cited

U.S. PATENT DOCUMENTS 4,808,955 A * 2/1989 Godkin et al. ..... 335/222
5,345,206 A * 9/1994 Morcos ..... 335/222

* cited by examiner

*Primary Examiner*—Elvin Enad
*Assistant Examiner*—Bernard Rojas
(74) *Attorney, Agent, or Firm*—Christopher H. Hunter

(57) ABSTRACT

The invention relates to an actuator for actuating a valve installed in a hydraulic or compressed air system comprising a coil support which can be displaced by means of air space induction in a magnetically conducting housing on a magnetic cylinder composed of a permanent magnet and a cylinder pole disk. The invention is characterized in that the dimensions of the permanent magnet and the pole disk correspond to each other in such a way that the diameter of the front surface of the permanent magnet is at least the same size as the circumferential surface of a neighboring pole disk and that the width of the coil associated with the pole disk exceeds the width of the pole disk by the lift amplitude of the coil support. According to the invention, the actuator for actuating a valve used in fluidic engineering is disposed in such a way that the coil support is displaceable in a fluidic medium and the air gap arranged between the coil support and a magnetic cylinder pipe surrounding the permanent magnet and the associated pole disk has a maximum width whereby a laminated lubricating film is formed without displacing the surrounding fluid.

35 Claims, 4 Drawing Sheets

ACTUATOR FOR A FLUID VALVE

CROSS REFERENCE TO RELATED CASES

This application is a continuation-in-part of U.S. patent application Ser. No. 10/416,707; filed Sept. 11, 2003, now U.S. Pat. No. 6,075,195 which is the national phase under Chapter II of International Application No. PCT//EP01/13200, filed Nov. 14, 2001 and which claims priority to German Patent Application No. 100 56 332.56, filed Nov. 14, 2000.

BACKGROUND OF THE INVENTION

The invention relates to an actuator for actuating a valve, with a housing shell made of a magnetically conductive material, a coil support that has an actuation projection and is displaceable within the housing shell while forming an air gap relative thereto, with at least one current-carrying coil wound onto its circumference and with a magnet cylinder enclosed by the coil support while forming an air gap, with a sequence of permanent magnet and pole disk made of a magnetically conductive material arranged axially in the cylinder's interior, wherein the axial width of the coil is greater than the axial length of the pole disk associated with the coil.

An actuator with the described features is disclosed in U.S. Pat. No. 5,345,206. In principle, this actuator can also be used to actuate a valve. The prior-art actuator has a housing, which is closed on one end and is made entirely of a magnetically conductive material. The coil support, which can be driven out of the housing by an actuation projection, is displaceable within the housing. The prior art actuator is distinguished in that the pole disks are narrow compared to the permanent magnets arranged adjacent thereto, and the coils wound onto the coil support are much wider than the associated narrow pole disks.

With this configuration of the prior-art actuator, based on a magnetic saturation of the narrow pole disks, a leakage field from the permanent magnets acting on the coils overlapping the permanent magnets is to be produced deliberately. This configuration accepts the drawback that the magnetic flux provided by the permanent magnet cannot be completely converted into a useful flux to move the coil support, and that the field lines, to a large extent, must overcome a longer path in the air gap next to the pole regions, so that a larger amount of magnetic material is required. To take into account the leakage flux, the coils are dimensioned to overlap by far the width of the associated pole disk. As a result, a relatively large amount of coil material is located on the coil support. This has not only the drawback of increasing the mass of the coil support that must be moved when the actuator is in operation, but the coil is also strongly heated because of the power that is supplied to a coil with a corresponding winding mass. This heating affects the actuator's heat balance and causes the individual coil bodies to expand and consequently to influence the size of the specified air gap and to limit the maximum possible energy density.

These drawbacks have the result that an actuator of the prior art cannot be used to control or actuate valves used in fluid engineering applications. Thus, the object of the invention is to provide an actuator with the initially described features for use in fluid engineering applications. Fluid engineering in this context primarily means the actuation of valves used in hydraulic and compressed air applications.

The means to attain this object, including advantageous embodiments and further developments of the invention, are set forth in the claims, which follow this description.

SUMMARY OF THE INVENTION

In its basic concept, the invention provides that the dimensions of permanent magnet and pole disk are matched to each other in such a way that the end face cross-sectional area of the permanent magnet corresponds to at least the circumferential surface of a neighboring pole disk and that the width of the coil associated with the pole disk overlaps the width of the pole disk by the stroke amplitude of the coil support. Furthermore, the actuator to actuate a valve installed in a hydraulic or compressed air system is arranged in such a way that the coil support is displaceable in a fluid medium and the air gap between the coil support and a cylindrical magnet tube enclosing the permanent magnet and the associated pole disk is at maximum wide enough that a laminar lubricating film is established between the parts without displacing the surrounding fluid.

The invention has the advantage that, first, the leakage flux, which does not contribute to the force acting on the coil support, is kept low because the entire magnetic flux in the area of the pole disk is guided radially through the air gap between the cylindrical magnet tube and the housing or the housing shell along the geometrically shortest path, so that all the coil conductors are exposed to the maximum air gap induction. To ensure this for the entire axial movement of the coil support relative to the fixed cylindrical magnet tube, it is provided according to the invention that the width of the coil associated with the pole disk overlaps the width of the pole disk by the stroke amplitude of the coil support. Since the extent of the coils is thereby limited to the degree necessary, this has the advantage of resulting in an arrangement of coils with the smallest possible self-inductance and with a low winding weight.

The size of the air gap between the coil support and the cylindrical magnet tube is decisive for the leakage flux, which according to the invention is to be prevented. The invention therefore provides that the smallest possible air gap be adjusted by making the air gap between the coil support, which is displaceable in the fluid medium, and the cylindrical magnet tube at maximum wide enough so that a laminar lubricating film is established between the parts without displacing the surrounding fluid. On the one hand this especially takes into account the use of the actuator in fluid engineering applications because it provides a type of sleeve bearing arrangement of the coil support on the cylindrical magnet tube with the lowest possible frictional losses. The displacement of the fluid surrounding the coil support, caused by the axial movement of the coil support in the fluid, occurs on the outside of the coil support. If the actuator is used in hydraulic applications, the available hydraulic fluid ensures the formation of the lubricating film. On the other hand, in compressed air applications, the compressed air itself causes a corresponding lubricating film to form. In general, the fluid contained within the actuator during the specific application will cause a lubricating film to form between the coil support and the magnet tube. Of course, it should be appreciated that the foregoing relates only to applications including non-magnetic fluid, as magnetic fluid would short the flux gap between the coil support and the magnet tube.

To form the actuation projection acting on the valve influenced by the actuator, the sleeve-type coil support on its one end face may be equipped with a support star having radially inwardly extending spokes, in the center of which a tappet protruding from the housing is connected as the actuation projection.

In a first embodiment with respect to the configuration of the actuator housing, the invention provides that the housing shell is a component of a closed housing containing the displaceable coil support and the cylindrical magnet tube. The tappet reaches through an opening in the associated end face of the housing.

To the extent that an undesirable leakage flux does occur, particularly on the permanent magnet or the pole disk adjacent to the housing end face facing away from the support star of the coil support, it is provided that in a housing made entirely of a conductive material a spacer made of a magnetically non-conductive material be disposed between the end of the cylindrical magnet tube and the end face of the housing. As an alternative, the end face of the housing may be made of a magnetically non-conductive material.

In a basic configuration of coil support and magnet cylinder, the invention provides for a magnet module, which is formed by a permanent magnet disposed in the center of the magnet cylinder and two pole disks arranged on the outside. A partial coil on the coil support is associated with each pole disk in the magnet module. The partial coils of a magnet module are wound in opposition and are mechanically and electrically connected with each other, so that mutual induction is also avoided.

One embodiment of the invention provides that a single magnet module be arranged within the housing shell of the actuator. Because of the resulting compact symmetrical construction of the magnet module, a relatively large power density is generated due to the relatively low magnetic leakage losses according to the invention. This, in conjunction with a low mass inertia of the coil support including the coil windings formed thereon, makes possible rapid alternating movements or a rapid unilateral displacement of the coil support. The self-inductances of the partial coils are kept low. As a result, current changes are so rapid that, for example, stroke adjustments over several millimeters can be achieved in a few milliseconds.

Due to the dimensional relationships according to the invention regarding the relative size of permanent magnet and pole disk on the one hand and pole disk and coil winding on the other, the resulting axial magnet lengths are short, especially in view of the desired small overall size of the actuator according to the invention. As a consequence, depending on the application, the induction of an individual permanent magnet may not be sufficient for the desired movement of the coil support. According to one embodiment of the invention it is therefore provided that a plurality of magnet modules be arranged axially in series within the housing shell. In this case, like poles of the permanent magnet of each magnet module are located axially opposite each other. The outer pole disks of each magnet module are joined into a one-piece composite pole disk.

In an arrangement of alternating permanent magnet and pole disk within the cylindrical magnet tube, a leakage flux may result in the area of the pole disks lying at the outer ends because the magnetic flux emanating from the inner permanent magnet is not completely diverted in the pole disk in the direction of the coil that covers the pole disk. One embodiment of the invention therefore provides that an edge magnet, whose strength is adjusted to compensate the magnetic leakage flux occurring at the ends of the cylindrical magnet tube, be arranged at the ends of the cylindrical magnet tube formed by the outer pole disks of the magnet module or modules and connected with the magnetically conductive housing shell. As a result, the magnetic flux emanating from the edge magnet is closed via the housing, which is connected with the edge magnet. Since the edge magnet needs to compensate only the leakage losses in the area of the associated pole disk, it does not need to have the same axial dimensions as the primary magnet or magnets arranged in the magnet carrier.

A special embodiment of the invention provides for the arrangement of edge magnets and claw poles in all the actuators of the class, irrespective of the structure of a magnetic cylinder as such, i.e. irrespective of whether a cylindrical magnet tube is provided.

In a housing that is open on one side in the area of the tappet, it is useful, according to one embodiment of the invention, if the inner edge magnet of the cylindrical magnet tube rests against the magnetically conductive end face of the housing on the closed housing side.

To make it possible to compensate such leakage losses also on the side of the housing that is open in the area of the tappet, one embodiment of the invention provides that the housing, at its open end face, has magnetically conductive claw poles extending radially inwardly and axially between the spokes of the support star of the coil support. These claw poles are in magnetically adhesive engagement with the associated edge magnet of the magnet cylinder or the cylindrical magnet tube. This has the particular advantage that due to the magnetic flux established between the magnetically conductive housing or the claw poles and the edge magnets of the magnet cylinder, the magnet cylinder or the cylindrical magnet tube is immovably mounted within the housing without any additional fastening elements. The magnetic holding forces are so large that even substantial external forces are unlikely to change the position of the magnet cylinder or the cylindrical magnet tube within the housing.

This type of fixation within the housing of the magnet cylinder or the cylindrical magnet tube further makes it possible, according to one embodiment of the invention, to configure the housing shell open on both sides with claw poles formed at both ends. The coil support displaceable within the housing shell can have a support star on each of the end faces with a tappet protruding therefrom.

Specifically, the claw pole may be configured to correspond in shape with the gaps between the spokes of the support star.

The fixation of the magnet cylinder or the cylindrical magnet tube in the housing provides the means for the claw poles to form an anti-rotation protection for the support star and tappet insofar as twisting forces, which occur in the interaction of the actuator with the valve used in fluid engineering applications upon startup of the valve, may be transmitted to the tappet and thus to the coil support via the support star. To avoid contact friction over an area between the fixed claw poles and the coil support as the latter is being displaced, one embodiment of the invention provides that at least one claw pole has, for example, a knob-like or linear projection relative to the associated spoke of the support star, so that area friction is avoided and only point friction or linear friction is permitted. Correspondingly, a projection may be formed on a spoke and rest against the claw pole.

Advantageously, it is furthermore possible that a claw pole and/or the magnet cylinder or the cylindrical magnet tube mounted between claw pole and housing, or between the claw poles on the two sides, forms a fixed mount for the sensor of a position measuring system in relation to the housing. Movements of the carrier of the sensor that would distort the measuring results of the position measuring system are thus excluded.

According to one embodiment of the invention, the structure of a magnet module, or of a plurality of magnet modules, can be such that a magnet module is formed by a pole disk arranged in the center of the cylindrical magnet tube with two permanent magnets disposed on both sides thereof. Like poles of the permanent magnets are located axially opposite each other, and a coil associated with the pole disk disposed in the center is wound on the coil support. This has the advantage that the permanent magnets disposed at the outer ends of the cylindrical magnet tube simultaneously act as edge magnets and thus enable the cylindrical magnet tube to be fixed directly between claw poles and housing, or between the claw poles fixed to the housing on the two sides. This arrangement, in contrast to the arrangement using additional edge magnets, advantageously makes it possible to reduce the number of magnets while retaining the same configuration of the force effect. According to one embodiment of the invention, a plurality of alternating pole disks and permanent magnets may be disposed between two outer permanent magnets.

One embodiment of the invention provides that a preloaded spring is arranged between the support star of the coil support and the end-face side of the cylindrical magnet tube to bias the tappet in its coupling position with a valve connected to the actuator.

With respect to the configuration of the coil support, including the coil windings formed thereon, the coil support, which is made of an electrically non-conductive material, e.g. plastic, fabric-based laminate or ceramic, may be provided with coil recesses into which the individual coils are wound. According to one embodiment of the invention, the coils wound into the recesses of the coil support can furthermore be covered with a protective layer to impart a smooth surface to the respective coil support provided with the coils. Such a configuration of the coil support makes it possible to realize very small air gaps between the coil support and the cylindrical magnet tube on the one hand and the housing shell on the other.

Finally, a further embodiment of the invention provides that grooves be disposed on the inside of the housing shell extending in its longitudinal direction to allow the passage of the fluid displaced during the axial movement of the coil support inside the housing shell. This makes it possible to realize a small air gap between the coil support and the housing shell, despite the displacement of the fluid surrounding the coil support that occurs when the coil support moves. Corresponding grooves may be provided on the outer circumference of the coil support, if necessary.

DETAILED DESCRIPTION OF THE PREFERRED EMBODIMENT

Figure 1:
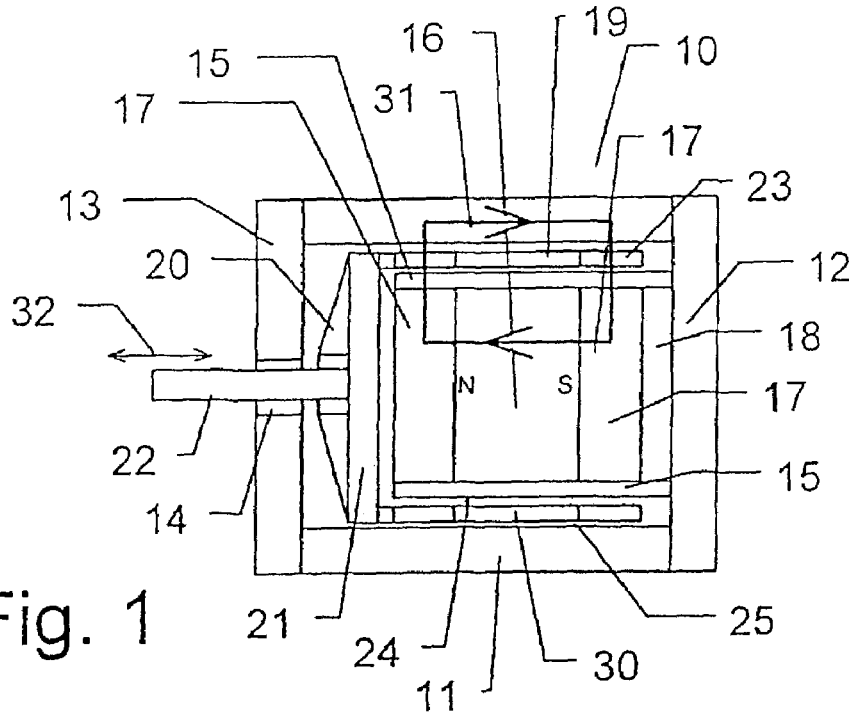
FIG. 1 is a schematic longitudinal section of an actuator with a magnet module consisting of a central permanent magnet with pole disks arranged on the outside.

The actuator shown schematically in FIG. 1 has a housing 10 whose outer housing shell 11 is made of a magnetically conductive material. The closed end face 12 of the housing 10 is made of a different material, i.e. a magnetically non-conductive material, for reasons that will be explained below, while the opposite end face 13 is made of a magnetically conductive material and is provided with a central opening 14.

A cylindrical magnet tube 15 is arranged in the interior of the housing 10 and connected on one side with the closed end face 12 of the housing 10. The cylindrical magnet tube 15 is made of a magnetically non-conductive material. In its interior a permanent magnet 16 is arranged in a centered position. A pole disk 17 each is disposed on the two end faces of this magnet. Between the pole disk 17 in proximity of the closed end face 12 of the housing 10 and said end face 12, a spacer 18 is furthermore arranged, which is made of a magnetically non-conductive material. The purpose of this spacer is to provide sufficient clearance for the movement of the coil support, which will be explained below, in view of the geometric proportions of permanent magnet 16 and pole disk 17, which will also be explained below.

In the annular space between the cylindrical magnet tube 15 and the outer housing shell 11, a sleeve-type coil support 19 made of a magnetically and electrically non-conductive material, e.g. plastic, fabric-based laminate or ceramic, is disposed so as to be axially displaceable. An air gap 24 is arranged between the magnet cylinder 15 and the coil support 19, and an air gap 25 between the coil support 19 and the outer housing shell 11. On the side facing away from the closed end face 12 of the housing, the coil support is provided with a support star 20 formed by radially inwardly projecting spokes 21. A tappet 22 protruding axially through the opening 14 of the end face 13 of the housing 10 is arranged in the center of the support star 20 and is connected with the support star 20.

Figure 8:
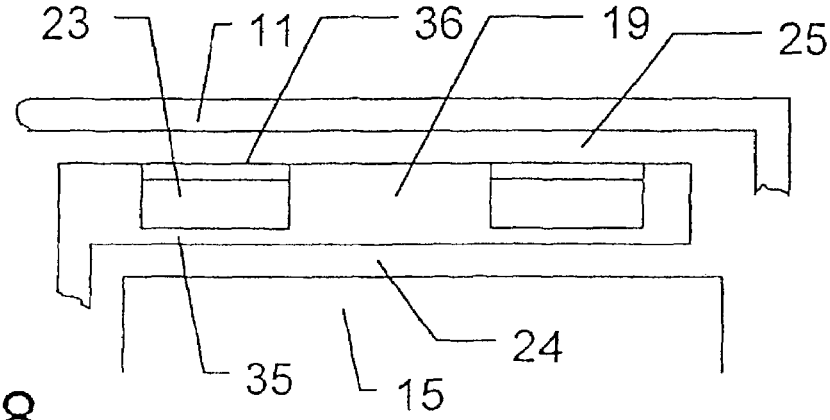
FIG. 8 shows a detail of a coil support in cross section.

As indicated only schematically in FIG. 1 and somewhat more clearly in FIG. 8, two coils 23 made of a suitable material, preferably copper or aluminum wire, are wound onto the coil support 19 in the embodiment depicted in FIG. 1. These coils 23 axially cover the pole disks 17 and are wound in opposition to each other.

For the high dynamics required in the actuators according to the invention, it is essential on the one hand to configure the coils 23 with the smallest possible self-inductance and a low winding weight and on the other hand to guide the entire magnetic flux emanating from the permanent magnet 16 as radially as possible in the area of the pole disks 17 through the air gap 24 between the cylindrical magnet tube 15 and the coil support 19, so that the coils 23 located on the coil support 19 are subject to the maximum air-gap induction during the entire axial movement of the coil support. To minimize the leakage flux, which does not contribute to the force production, the magnets should be short and the air gaps small. For this reason, in a manner not visible in the schematic representation of FIG. 1, the dimensions of permanent magnet 16 and pole disks 17 are adjusted to each other in such a way that the end face cross-sectional area of the permanent magnet corresponds to at least the circumferential surface of the respective pole disk. Put briefly, this is true if the axial length of the magnet and the axial length of the pole disks 17 correspond to approximately half the diameter of the permanent magnet 16. Longer pole disks are perfectly feasible within the scope of the concept according to the invention. Moreover, each of the two coils 23 must overlap the width of the associated pole disk 17 by the stroke amplitude of the coil support 19 to achieve the largest possible force during the entire movement of the coil support 19. The two coils 23 are spatially separated in axial direction by a non-conductive spacer region 30 of the coil support 19 but are electrically connected with each other via the winding wire. Since the two coils 23 are furthermore wound in opposition, mutual inductance is avoided.

To prevent leakage flux, which cannot be utilized, the air gap 24 between the cylindrical magnet tube 15 and the coil carrier 19 must also be kept small. Thus, the air gap 24 should at maximum be wide enough so that a laminar lubricating film is established between the parts 15, 19 without displacing the fluid surrounding the coil support 19 or the cylindrical magnet tube.

In the construction illustrated in FIG. 1 of an actuator with a magnet module that has the described structure and is arranged in the housing 10, the permanent magnet 16 generates a homogenous magnetic field directed from the inside radially toward the outside in the region of the coils 23 in the entire air gap 24, 25 between the cylindrical magnet tube 15 and the housing shell 11. This magnetic field, as indicated by the flux direction 31, can be closed through the magnetically conductive annular housing shell 11. In a homogenous magnetic field with a force proportional to the coil current, the magnetic air gap induction and the number of turns of the two coils 23, the direct current carrying coils 23 are displaced perpendicularly to the direction of the magnetic field. For this purpose, a current is supplied to the coils 23 disposed on the displaceable coil support 19 through highly flexible cables (not depicted). Displacement of the coil support 19, and thus an axial movement of the tappet 22, occurs as long as current carrying conductors, i.e. the coils 23, are located within the magnetic field. When the current is switched, the direction of movement of the coil support 19 also reverses, resulting in a back and forth movement of the coil support 19, or the tappet 22 carried by it, as indicated by arrow 32. Since the arrangement depicted in FIG. 1 is free from transverse magnetic forces the coil support 19 can be guided within the recess 14 of the housing 10 without any additional bearing arrangement because the air gap 24 is adjusted to enable a laminar lubricating film to form. This is a particular advantage in operation.

Figure 2:
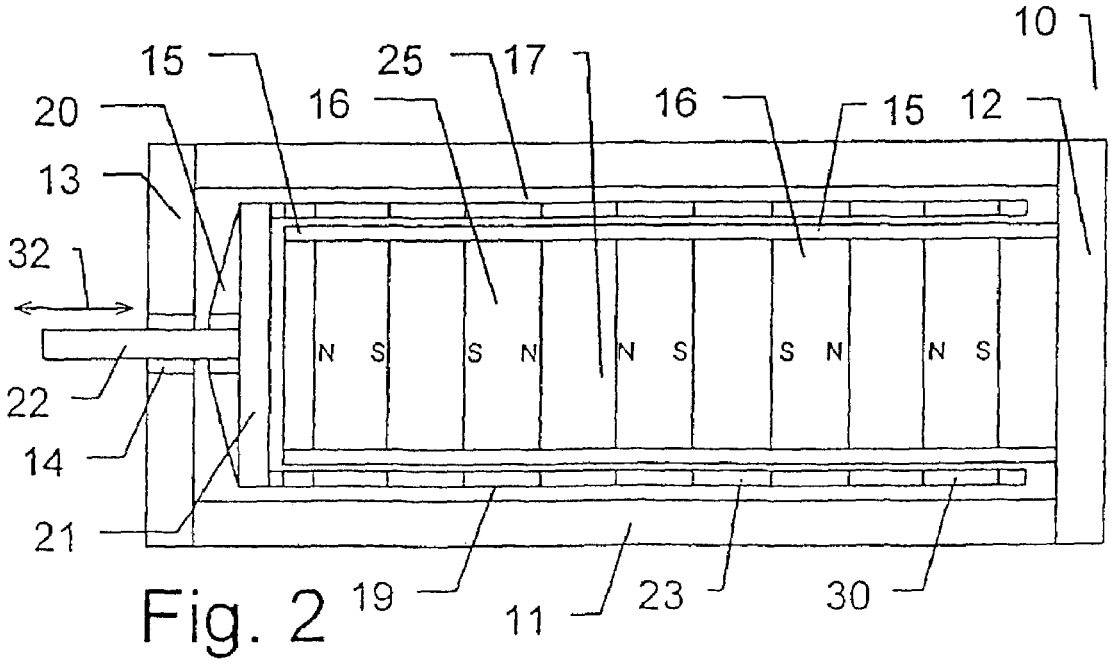
FIG. 2 shows an actuator corresponding to FIG. 1 with a plurality of magnet modules.

The exemplary embodiment depicted in FIG. 2 essentially is distinguished from that of FIG. 1 by a plurality of magnet modules having a central permanent magnet 16 and outer pole disks 17 in the cylindrical magnet tube 15, as depicted in FIG. 1. The two pole disks 17, which are associated with permanent magnets 16 respectively arranged at a distance from one another, are combined into a single and consequently wider pole disk. The coils 23 associated with the wider pole disks 17 have a corresponding width plus the specified overlap corresponding to the stroke amplitude of the coil support.

Figure 3:
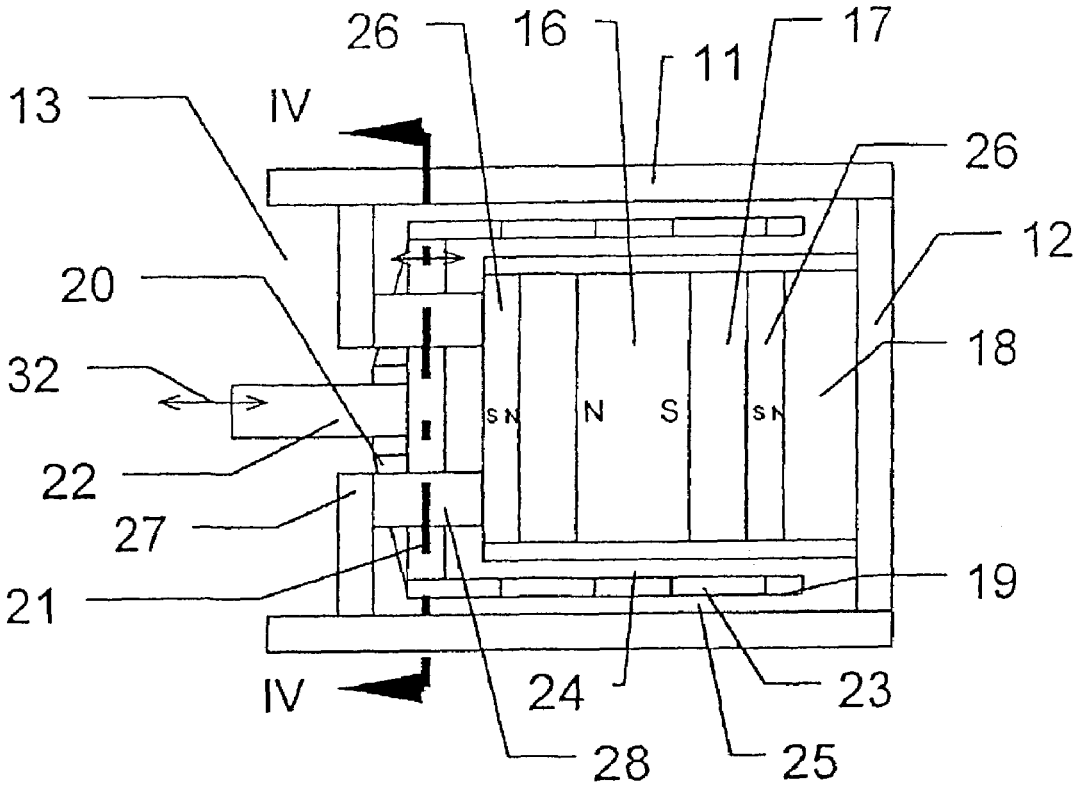
FIG. 3 is a longitudinal section of an actuator according to FIG. 1 with additional edge magnets.

In principle, the structure of the embodiment depicted in FIG. 3 corresponds to that shown in FIG. 1. At the outer ends of the cylindrical magnet tube 15, an additional edge magnet 26 each is arranged, whose magnetic strength is adjusted to compensate the magnetic leakage flux occurring at the ends of the cylindrical magnet tube 15, i.e. this leakage flux is compensated by the magnetic flux of the edge magnets 26. The relation of the ratio of the size of the permanent magnets 16 and the associated pole disks 17 thus does not apply to the design of the edge magnets. To enable the edge magnets 26 to be effective, they must be connected to the housing 10, which is made of a magnetically conductive material, so that a corresponding magnetic flux is established. On the side of the cylindrical magnet tube 15 facing away from the tappet 22 this is accomplished by making the respective end face 12 of the housing 10 and the corresponding spacer 18 of a magnetically conductive material.

At the end face 13 opposite the end face 12, radially inwardly extending magnetically conductive mounts 27 with claw poles 28 axially mounted thereto are provided to form a magnetically conductive connection with the edge magnet 26 that is arranged there. The claw poles 28 reach between the spokes 21 of the support star 20 of the coil support 19 (FIG. 4) and rest against the outer edge magnets 26 of the magnet cylinder 15. The magnetically conductive mounts 27 can also be configured, for example, as a circumferential disk from which claw poles start, which is connected with the housing shell 11. Due to the magnetic forces, the magnet cylinder 15 is thus firmly connected with the end face 12 of the housing 10 on the one hand and with the claw poles 28 forming an integral part of the housing 10 on the other, so that a stable configuration results, which can withstand even a relatively large force acting thereon. For this reason, the claw poles 28 are particularly suitable for use as an anti-rotation protection for the support star 20 of the coil support 19 with tappet 22 or as a mount for the sensor of a position measuring system.

Figure 4:
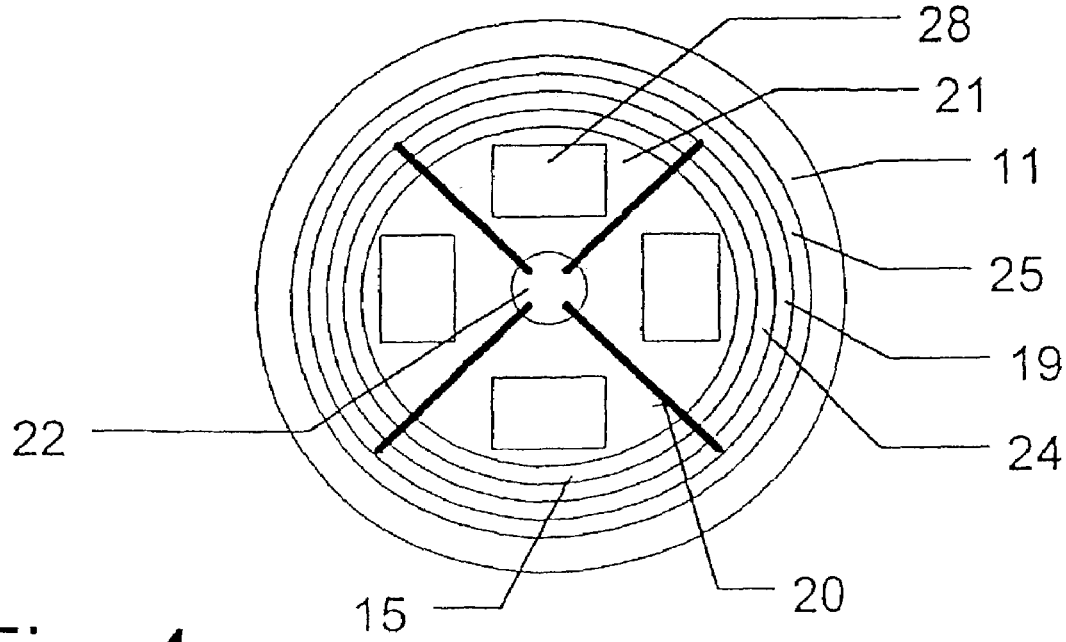
FIG. 4 is a section taken along line IV—IV in FIG. 3.
Figure 5:
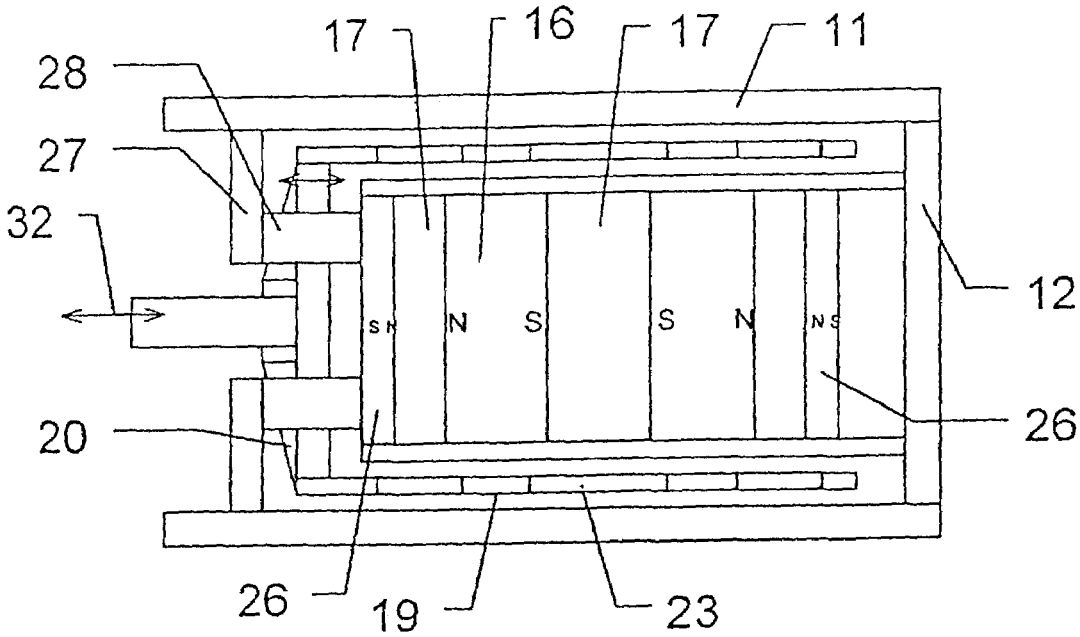
FIG. 5 shows the subject of FIG. 3 with an arrangement of a plurality of magnet modules.

As shown in FIG. 5, it is also possible in an embodiment of the actuator according to the invention shown in FIGS. 3 and 4 to provide a sequence of permanent magnets 16 and pole disks 17 within the cylindrical magnet tube with corresponding edge magnets 26.

Figure 6:
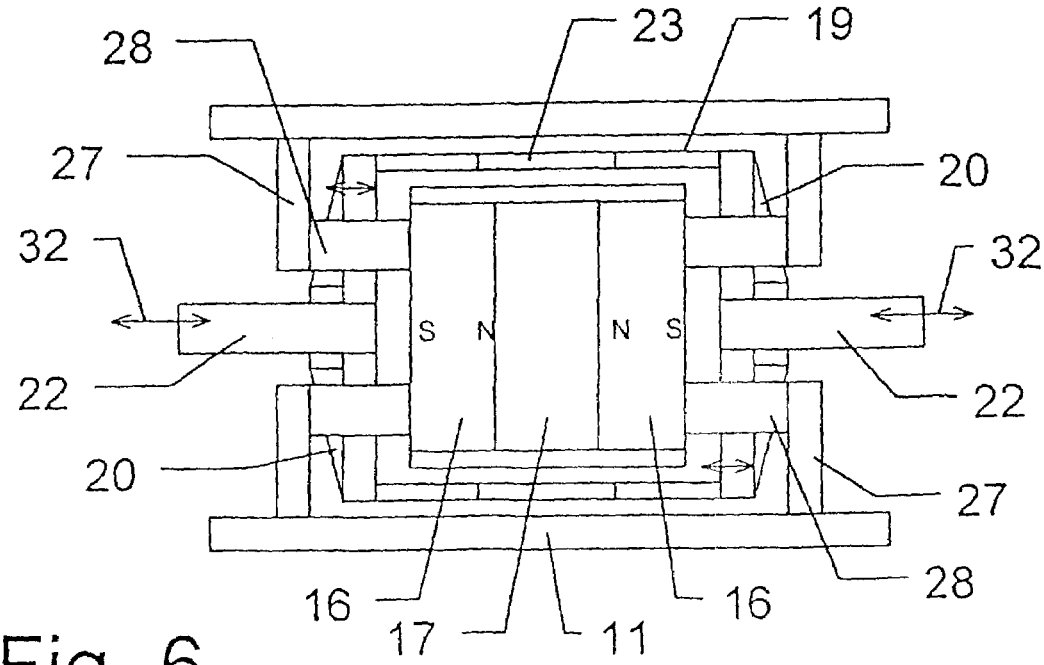
FIG. 6 is an embodiment of the actuator according to FIG. 3 with a housing that is open on both sides, with correspondingly arranged claw poles and with a central pole disk and outer primary magnets.
Figure 7:
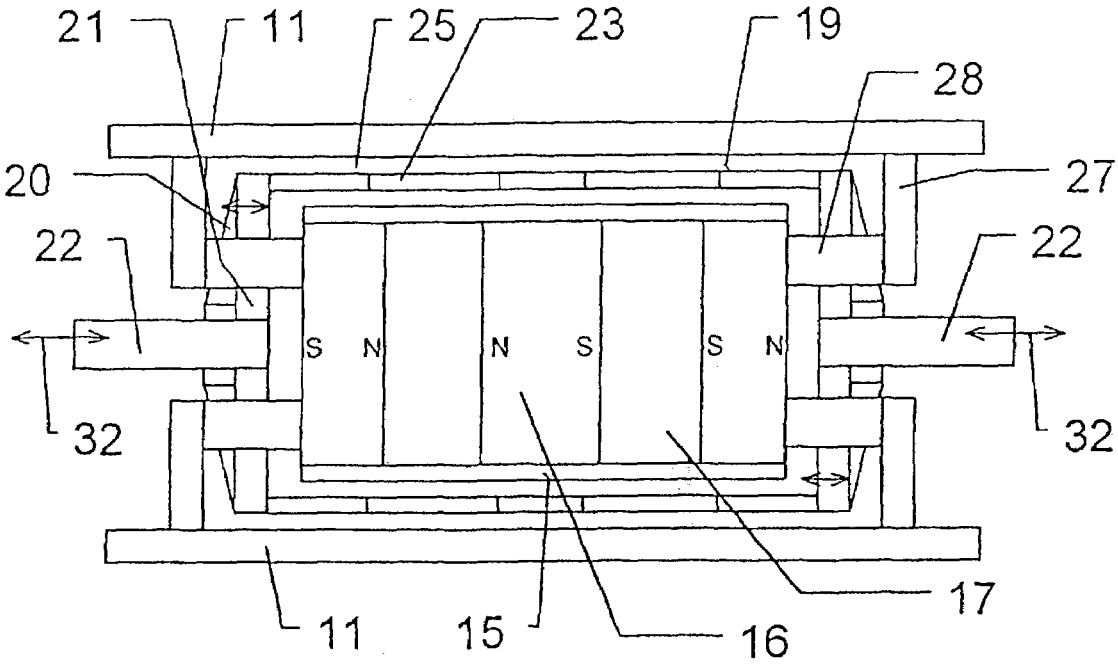
FIG. 7 shows the subject of FIG. 6 with an arrangement of a plurality of primary magnets and pole disks.

Another means of using the advantages of the actuator depicted in FIGS. 3 and 4 is illustrated in FIG. 6 in which the housing 10 is open on both sides and therefore has claw poles 28 on both sides. As a result, the coil support 19, via a support star 20, can be provided with tappets 22 protruding on both sides from the housing 10. This makes it possible to actuate connected units in both directions of movement of the coil support 19 within the housing 10. Since the cylindrical magnet tube 15 is again firmly mounted by means of the two claw poles 28 fixed to the housing and arranged on both sides, the cylindrical magnet tube 15 is supported on both sides without interfering with the two-sided actuation by means of the two tappets 22 disposed on both sides. A further difference between the embodiments depicted in FIG. 6 and in FIGS. 3 or 5 is that in the embodiment according to FIG. 6 a central pole disk 17 is arranged with a permanent magnet 16 disposed on each side thereof inside the cylindrical magnet tube 15. These outer permanent magnets 16 simultaneously act as edge magnets. The edge magnets that are still provided in FIGS. 3 and 5 can be eliminated here, while the force effect remains the same. This saves magnetic material. As shown in FIG. 7, such an arrangement can also be implemented with a sequence of several pole disks 17 and permanent magnets 16. Finally, FIG. 8 by way of example shows the configuration of a coil support 19. In the embodiment shown, recesses 35 to accommodate the coils 23 are made in the outer surface of the coil support 19. The coils 23 are wound into these recesses. Thereafter, the recesses 35 or coils 23 are covered or encapsulated with a protective layer 36. This results in a correspondingly smooth outer circumference of the coil support 19, making it possible to adjust small air gaps 24, 25.

The features of the subject of these documents as disclosed in the above description, the claims, the abstract and the drawing can be significant either alone or in any combination in the implementation of the invention and its various embodiments.

We claim:

1. An actuator for actuating a valve in a fluid system, the actuator comprising a closed housing shell made of a magnetically conductive material, circumscribing a central axis and containing a non-magnetic fluid medium, a coil support having an actuation projection and being axially displaceable within the fluid in the housing shell and forming a first air gap with respect to the shell, with at least one current-carrying coil wound onto the circumference of the coil support and extending along a predetermined axial extent of the support, and with a cylindrical magnet tube enclosed by the coil support and forming a second air gap with respect to the support, with a sequence of a permanent magnet and a pole disk made of a magnetically conductive material arranged axially in the tube's interior, wherein the axial extent of the coil is greater than the axial extension of the pole disk associated with the coil, and the dimensions of the permanent magnet and the pole disk correspond to one another such that i) the end face cross-sectional area of the permanent magnet corresponds to at least the circumferential surface of the pole disk; and ii) the axial extent of the coil associated with the pole disk overlaps the axial extension of the pole disk by the stroke amplitude of the coil support, wherein the width of the second air gap between the coil support and the cylindrical magnet tube is sufficient such that a laminar lubricating film is established between the cylindrical magnet tube and coil support without displacing fluid surrounding the coil support when the coil support is displaced.

2. The actuator as in claim 1, wherein the coil support has an end face with a support star including radially inwardly projecting spokes, in the center of which is a tappet is connected which protrudes from the housing shell as an actuation projection.

3. The actuator as in claim 2, wherein the housing shell encloses the coil support and the cylindrical magnet tube, and wherein the tappet extends through an opening in an associated end face of the housing shell.

4. The actuator as in claim 3, wherein the end face of the housing shell is made of a magnetically conductive material, and a spacer made of a magnetically non-conductive material is arranged at an end of the cylindrical magnet tube facing the housing shell end face.

5. The actuator as in claim 3, wherein the end face of the housing shell is made of a magnetically non-conductive material.

6. The actuator as in claim 1, wherein a magnet module is formed by a permanent magnet centered inside the cylindrical magnet tube and by two pole disks arranged on opposite sides of the permanent magnet, wherein each pole disk in the magnet module is associated with a coil on the coil support, and wherein the coil windings of a magnet module are wound in opposite directions and are mechanically and electrically connected with each other.

7. The actuator as in claim 6, wherein the housing shell encloses the magnet module.

8. The actuator as in claim 6, wherein a plurality of magnet modules are disposed axially one next to another within the housing shell, wherein like poles of the permanent magnet of each magnet module are located axially opposite one another.

9. The actuator as in claim 8, wherein outer pole disks of each magnet module are joined together into a one-piece compound pole disk.

10. The actuator as in claim 6, wherein an edge magnet is arranged on each end of the cylindrical magnet tube formed by outer pole disks of the magnet module, the strength of the edge magnets chosen so as to compensate for magnetic leakage flux occurring at the ends of the cylindrical magnet tube, and wherein each edge magnet is connected with the housing shell.

11. The actuator as in claim 1, wherein longitudinal grooves are disposed on the inside of the housing shell to allow passage of fluid displaced when the coil support moves axially within the housing shell.

12. An actuator for actuating a valve comprising a housing shell of a magnetically conductive material circumscribing a central axis, a coil support with an actuation projection and displaceable within the housing shell while forming a first air gap with respect thereto, with at least one current-carrying coil wound onto the circumference of the coil support along an axial extent thereof, and a cylindrical magnet tube enclosed by the coil support and forming a second air gap with respect thereto, with a sequence of one or more permanent magnets and one or more pole disks made of a magnetically conductive material arranged axially in the tube's interior, with each pole disk having an associated coil, wherein the axial extent of the coil is greater than the axial extension of a pole disk associated with the coil, and wherein on each end of the cylindrical magnet tube formed by an outer pole disk of a magnet module, with the magnet module comprising a permanent magnet centrally located between two outer pole disks, an edge magnet is arranged and conductively coupled directly with an associated pole disk, whose strength is adjusted to compensate for the magnetic leakage flux occurring at the ends of the cylindrical magnet tube, and is connected with the housing shell.

13. The actuator as in claim 12, wherein the housing shell has an end face with an opening and supports an interior edge magnet of the cylindrical magnet tube; and a tappet, operatively connected to the coil support, extends through the end face opening.

14. The actuator as in claim 13, wherein the housing shell, at its open end face, has radially inwardly projecting claw poles made of a magnetically conductive material and extending axially between spokes of a support star of the coil support supporting the tappet, the claw poles being in magnetically adhering engagement with an associated edge magnet of the cylindrical magnet tube.

15. The actuator as in claim 14, wherein the housing shell is open on both ends and is configured with claw poles formed at both of its ends, and the coil support has a support star at each end face with a tappet protruding therefrom.

16. The actuator as in claim 15, wherein the claw poles are configured so as to correspond in their shape to the gaps between the spokes of the support star.

17. The actuator as in claim 16, wherein the claw poles provide anti-rotation protection for the support star.

18. The actuator as in claim 17, wherein at least one claw pole has a projection abutting an associated spoke of the support star.

19. The actuator as in claim 17, wherein at least one spoke of the support star has a projection abutting an associated claw pole.

20. The actuator as in claim 14, wherein the claw pole or the cylindrical magnet tube forms a mount for a sensor of a position measuring system.

21. The actuator as in claim 14, wherein a magnet module is formed by a pole disk centered inside the cylindrical magnet tube and by two permanent magnets arranged on opposite sides of the pole disk, wherein like poles of the permanent magnets are located axially opposite each other and a coil associated with the centered pole disk is wound onto the coil support.

22. The actuator as in claim 21, wherein a sequence of alternating pole disks and permanent magnets is arranged between two outer permanent magnets.

23. The actuator as in claim 15, wherein a preloaded spring is arranged between the support star of the coil support and an end face of the cylindrical magnet tube to apply pressure against the tappet in a coupling position with the valve.

24. The actuator as in claim 15, wherein the coil support has recesses to receive the windings of the coil.

25. The actuator as in claim 24, wherein a protective layer is applied over the windings of the coils, such that the coil support has a smooth circumferential surface.

26. The actuator as in claim in claim 12, wherein longitudinal grooves are disposed along the inside of the housing shell to allow passage of fluid displaced when the coil support moves axially within the housing shell.

27. An actuator for actuating a valve in a fluid system, the actuator comprising a closed housing shell made of a magnetically conductive material, circumscribing a central axis and containing a non-magnetic fluid medium, an annular non-conductive coil support having an actuation projection at one end and being axially displaceable through a stroke amplitude within the fluid in the housing shell and forming a first annular gap with respect to the shell, with at least one current-carrying coil winding circumferentially supported by the coil support, and with an annular magnet tube enclosed by the coil support and forming a second gap with respect to the coil support along an axial extent thereof, with a sequence of a permanent magnet and a pole disk made of a magnetically conductive material arranged axially in the tube's interior, wherein the axial extent of the coil is greater than the axial extension of the pole disk, and the dimensions of the permanent magnet and the pole disk correspond to one another such that i) the end face cross-sectional area of the permanent magnet corresponds to at least the circumferential surface of the pole disk; and ii) the axial extent of the coil overlaps the axial extension of the pole disk by the stroke amplitude of the coil support, and wherein the width of the second gap between the coil support and the magnet tube is sufficient such that a laminar lubricating film is established in the second annular gap between the coil support and magnet tube.

28. An actuator for actuating a valve in a fluid system, the actuator comprising a closed housing shell made of a magnetically conductive material, circumscribing a central axis and containing a non-magnetic fluid medium, an annular non-conductive coil support having an actuation projection at one end and being axially displaceable through a stroke amplitude within the fluid in the housing shell and forming a first annular gap with respect to the shell, with at least one current-carrying coil winding circumferentially supported by the coil support along an axial extent thereof, and with a magnet module, including a sequence of at least one pole disk made of magnetically conductive material and a permanent magnet, enclosed by the coil support and forming a second gap with respect to the coil support, wherein the axial extent of the coil is greater than the axial extension of the pole disk, and the dimensions of the permanent magnet and the pole disk correspond to one another such that i) the end face cross-sectional area of the permanent magnet corresponds to at least the circumferential surface of the pole disk; and ii) the axial extent of the coil is greater than the axial extension of the pole disk by no more than the stroke amplitude of the coil support, and wherein the width of the second gap between the coil support and the magnet module is sufficient such that a laminar lubricating film is established in the second annular gap between the coil support and magnet module.

29. The actuator as in claim 12, wherein the edge magnets are contiguous with the associated pole disk.

30. The actuator as in claim 12, wherein the housing shell has a closed end face of magnetically conductive material, and one of the edge magnets is conductively coupled to the end face.

31. The actuator as in claim 30, wherein a spacer of magnetically conductive material is disposed between the closed end face and the one edge magnet.

32. An actuator for actuating a valve comprising a housing shell of a magnetically conductive material circumscribing a central axis, a coil support with an actuation projection and displaceable within the housing shell while forming a first air gap with respect thereto, with at least one current-carrying coil wound onto the circumference of the coil support along an axial extent thereof, and a cylindrical magnet enclosed by the coil support and forming a second air gap with respect thereto, with a sequence of one or more permanent magnets and one or more pole disks made of a magnetically conductive material arranged axially in the tube's interior, with each pole disk having an associated coil, wherein the axial extent of the coil is greater than the axial extension of a pole disk associated with the coil, and wherein on each end of the cylindrical magnet tube formed by an outer pole disk of a magnet module, with the magnet module comprising a permanent magnet centrally located between two outer pole disks, an edge magnet is arranged and is conductively coupled directly to the associated pole disk, whose strength is adjusted to compensate for magnetic leakage flux occurring at the ends of the cylindrical magnet tube, and is directly magnetically coupled with the housing shell.

33. The actuator as in claim 32, wherein the edge magnets are contiguous with the associated pole disk.

34. The actuator as in claim 32, wherein the housing shell has a closed end face of magnetically conductive material, and one of the edge magnets is conductively coupled to the end face.

35. The actuator as in claim 34, wherein a spacer of magnetically conductive material is disposed between the closed end face and the one edge magnet.

* * * * *